United States Patent [19]

Erickson

[11] Patent Number: 4,715,874

[45] Date of Patent: Dec. 29, 1987

[54] RETROFITTABLE ARGON RECOVERY IMPROVEMENT TO AIR SEPARATION

[76] Inventor: Donald C. Erickson, 1704 S. Harbor Ln., Annapolis, Md. 21401

[21] Appl. No.: 904,901

[22] Filed: Sep. 8, 1986

[51] Int. Cl.[4] ..... F25J 3/04

[52] U.S. Cl. ..... 62/22; 62/29; 62/38

[58] Field of Search ..... 62/11, 22, 23, 24, 29, 62/38

[56] References Cited

U.S. PATENT DOCUMENTS

| | | | |
|---|---|---|---|
| 3,127,260 | 3/1964 | Smith | 62/22 |
| 3,729,943 | 5/1973 | Petit | 62/22 |
| 4,433,990 | 2/1984 | Olszewski | 62/22 |
| 4,453,957 | 6/1984 | Pahade et al. | 62/29 X |
| 4,533,375 | 8/1985 | Erickson | 62/22 |
| 4,604,116 | 8/1986 | Erickson | 62/22 X |

*Primary Examiner*—Albert J. Makay
*Assistant Examiner*—Steven E. Warner

[57] ABSTRACT

The argon recovery of an air distillation plant is increased by increasing the argon rectifier reboil and simultaneously decreasing the nitrogen stripping reboil. No additional power and minimal added equipment is required. Referring to FIG. 1, two separate argon rectifier reflux condensers (7 and 9) are provided, either for a single argon rectifier or optionally as shown for two separate argon rectifiers (12 and 13). Kettle liquid is partially evaporated in reflux condenser 7 and the liquid residue is further evaporated in reflux condenser 9 to a vapor of differing (higher) $O_2$ content. The two vapor stream are separately fed to different heights of column 2, separated by countercurrent contact zone 11.

20 Claims, 2 Drawing Figures

RETROFITTABLE ARGON RECOVERY IMPROVEMENT TO AIR SEPARATION

DESCRIPTION

1. Technical Field

The invention relates generally to the field of cryogenic air separation and more specifically to improvements which allow increased recovery of argon without increased power consumption.

2. Background Art

In some areas the industrial demand for argon exceeds the locally available supply, and costly measures must be adopted to fill the need. Thus it is desirable that air separation plants in the affected areas be designed for maximum practicable argon recovery. Many plants already in service have much lower argon recovery than that possible with modern technology. If those plants are in high argon demand areas, they would benefit from a low cost retrofit for increase argon recovery.

Because of the low relative volatility between oxygen and argon, the attainment of $O_2$ purities of about 98% or higher requires a large amount of reboil through the argon stripping section of the nitrogen removal column in a dual pressure distillation apparatus. Then the reboil is divided between the argon rectifier ("sidearm") and the $N_2$ stripping section of the main column. As disclosed in copending application Ser. No. 728264 filed Apr. 29, 1985 by Donald C. Erickson, in order to increase the argon recovery without increasing power input it is necessary to maximize the reboil fraction directed to the sidearm and correspondingly minimize the remainder of the reboil directed to the $N_2$ stripping section.

Copending application Ser. No. 893045 filed Aug. 1, 1986 by Donald C. Erickson discloses one way of accomplishing the above objective (increased reboil up the sidearm resulting in increased argon recovery). The key step is to feed part of the feed fluid to the $N_2$ rejection column as a vapor having $O_2$ content at least 3% higher than the kettle liquid $O_2$ content.

Petit (U.S. Pat. No. 3729943) discloses a variety of methods of latent heat exchange refluxing of both the top and the bottom of an argon sidearm, including having more than one latent heat exchange at the top of the sidewarm. However, none of the latent heat exchanges results in a vapor having higher $O_2$ content than the kettle liquid. Olszewski (U.S. Pat. No. 4433990) discloses a means to retrofit an "oxygen-only" air separation plant to additionally recover argon. Substantial added equipment and power input is required, including a distillation column, three heat exchangers, and a compressor. Smith (U.S. Pat. No. 3127260) discloses a means for minimizing the decrease in argon recovery which would otherwise occur when substantial amounts of liquid nitrogen and liquid oxygen are coproduced. The means disclosed is to vent to waste part of the impure evaporated kettle liquid which is generated by the argon sidearm overhead condenser. Since this vapor contains at least as much oxygen as does air, this technique necessarily results in a reduction in gaseous oxygen recovery. Smith further discloses providing two condensers at the argon sidearm overhead, one for generating sidearm reflux and the other for condensing product argon, with both being cooled by evaporating kettle liquid. However, only a single vapor feedstream to the $N_2$ removal column is generated thereby.

Copending application Ser. No. 853461 filed Apr. 18, 1986 by Donald C. Erickson discloses increasing $O_2$ pressure without an externally powered compressor and without decreasing $O_2$ recovery by companded TC LOXBOIL coupled with LAIRSPLIT (i.e., splitting the liquid air into two separate intermediate reflux streams for both the HP rectifier and the $N_2$ removal column).

What is needed, and one object of this invention, is a simple and low cost means of increasing argon recovery on high purity oxygen plants (purity >98%) which does not require additional power input and only requires minimal added equipment, for example, only one more heat exchanger and no compressor. Preferably, and partly as a result of the low cost and simplicity, the improvement should also be retrofittable on existing plants.

DISCLOSURE OF INVENTION

The improved result is obtained from process and apparatus whereby two separate exchanges of latent heat are conducted with condensing overhead vapor from the argon rectifier (sidearm) to provide reflux therefor. The first exchange is with partially evaporating kettle liquid, and the second exchange is with at least part of the liquid residue from the first exchange. Two vapor streams of differing $O_2$ composition are thus obtained, and they are fed to different heights of the $N_2$ removal column, the stream from the first latent heat exchange and thus with lower $O_2$ content being fed to the higher height. The two heights are separated by at least one tray or theoretical stage of counter-current vapor-liquid contact, and preferably by about 2 to 6 stages.

BRIEF DESCRIPTION OF THE DRAWINGS

FIG. 1 is a highly simplified schematic flowsheet showing only the essence of the invention, and omitting other details such as sensible heat exchangers, refrigeration producers, and the like. FIG. 1 depicts a retrofit scenario wherein a second argon rectifier must be added.

BEST MODE FOR CARRYING OUT THE INVENTION

Figure 1:
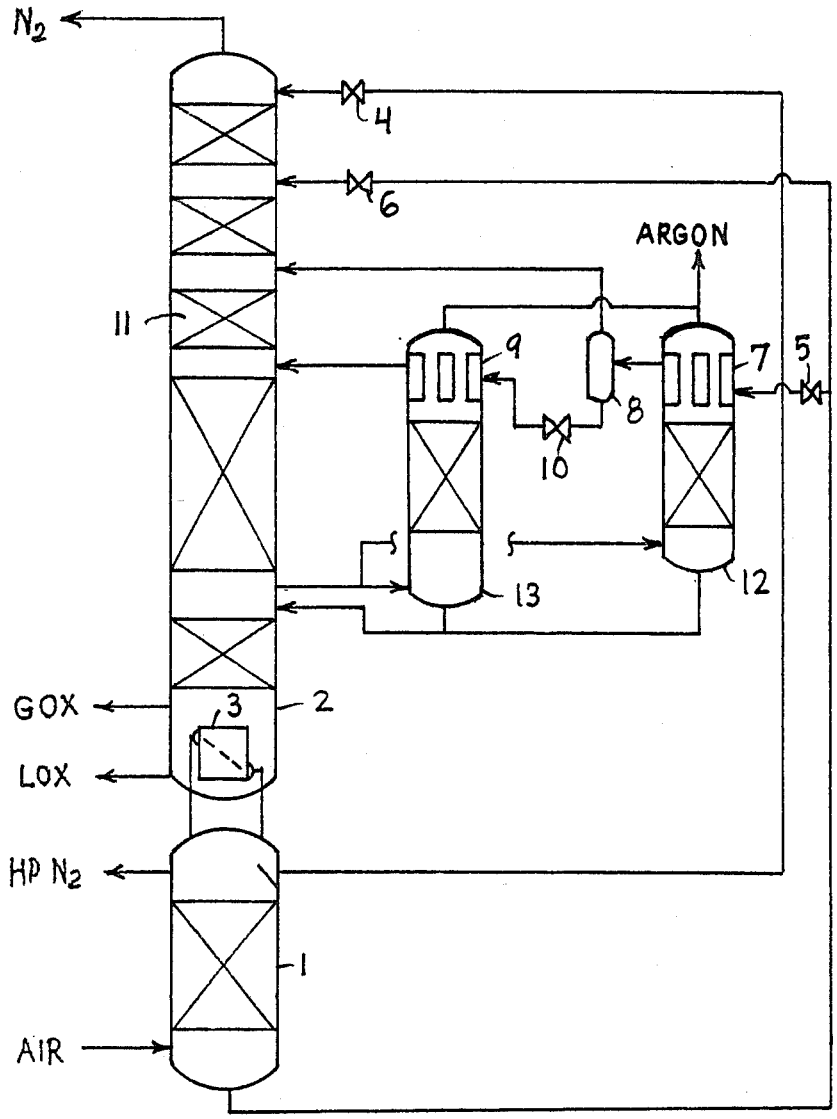

Referring to FIG. 1, compressed, cleaned and cooled feed air is supplied to high pressure rectifier 1 and is rectified to $N_2$ overhead product and oxygen enriched liquid bottom product (kettle liquid). Rectifier 1 exchanges latent heat with $N_2$ removal column 2 at latent heat exchanger 3, thereby providing reflux to 1 and bottoms reboil to 2. Liquid $N_2$ from 1 is depressurized by letdown valve 4 (or other known means for depressurization) and is direct injected to 2 as overhead reflux. Kettle liquid is preferably split by coordinated action of means for pressure letdown 5 and 6, with part supplied to column 2 as liquid feed and the remainder to the first of two argon rectifier overhead condensers, condenser 7. The kettle liquid is partially evaporated in 7, and then separated into vapor and liquid phases by phase separator 8. The liquid component is further directed to the second reflux condenser 9 via optional control valve 10. The two vapor streams from 8 and 9 necessarily have differing $O_2$ contents due to the vapor-liquid equilibrium prevailing in 8. The fluid stream from 9 is not necessarily entirely vapor, but that is allowable. In any event the two vapor-containing streams are fed to different heights of column 2, said heights being separated by a zone of counter-current vapor-liquid contact 11. The stream from 9, having higher $O_2$ content, is fed to the lower tray. Condensers 7 and 9 provide overhead reflux respectively to argon rectifiers 12 and 13, although it will be recognized that the two rectifiers could be combined into one.

Figure 2:
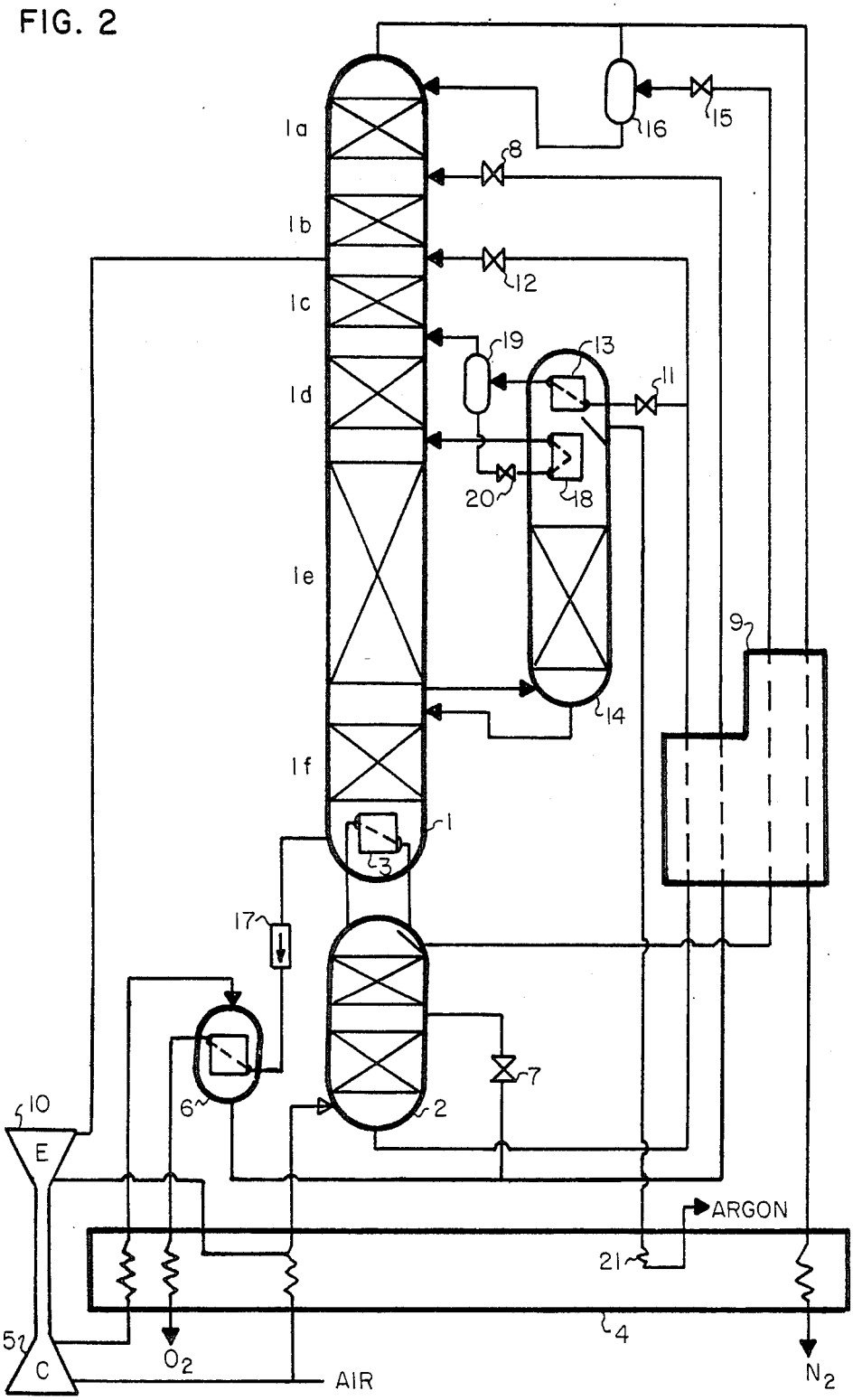
FIG. 2 is a somewhat more detailed flowsheet of one embodiment of the invention suitable for either retrofit or new construction.

Referring to FIG. 2, nitrogen removal column 1 is comprised of argon stripping section if, nitrogen stripping sections 1*e* (lower), 1*d*, and 1*c*, and nitrogen rectification sections 1*b* and 1*a*. High pressure rectifier 2 exchanges latent heat with column 1 via bottoms reboiler-/overhead reflux condenser 3. Rectifier 2 is supplied compressed air via main exchanger 4. The air may be dried and cleaned by any known technique: molecular siever, regenerators, reversing exchangers, caustic wash, and the like. Process refrigeration may be provided in any known manner, for example by expanding part (about 13 moles per 100 moles of compressed air (m/m) of the supply air in expander 10 to column 1 pressure. Product quality liquid oxygen may be evaporated to product oxygen by any known manner, although one preferred manner is to warm compress a minor fraction (about 30 m/m) of the supply air in compressor 5 powered by expander 10, and evaporate liquid oxygen which has been hydrostatically compressed (i.e., by a barometric leg) in LOX evaporator 6. The air totally condenses, and then is split by coordinated action of valves 7 and 8 to become intermediate reflux for both HP rectifier 2 and $N_2$ removal column 1. Component 17 prevents reverse flow of oxygen liquid or vapor, and may also incorporate a hydrogen adsorbing medium. Heat exchanger 9 exchanges sensible heat between column 1 overhead vapor and the various liquid streams en route to column 1: liquid $N_2$ via valve 15 and phase separator 16; liquid air via valve 8; and kettle liquid to valves 11 and 12. Valve 12 allows the optional introduction of part of the kettle liquid directly to column 1 as liquid; the remainder to valve 11 is evaporated to two vapor streams of differing $O_2$ content, and then those streams are separately fed to $N_2$ removal column 1. The two vapor streams of differing $O_2$ content are produced as follows. Argon rectifier 14, which in FIG. 2 is a sidearm of column 1, i.e., its bottom is in both vapor and liquid communication with the crude oxygen intermediate height of column 1, is refluxed by reflux condensers 13 and 18. Kettle liquid from valve 11 is supplied first to reflux condenser 13 at somewhat above column 1 pressure, where it is partially evaporated. The fluid from 13 is separated into liquid and vapor phases in phase separator 19, and the liquid component is directed to reflux condenser 18 via valve 20. The vapor from separator 19 and the at least partly evaporated fluid from reflux condenser 18 are fed to column 1 at different heights, for example, above and below section 1*d* as illustrated. Crude argon of about 95% purity is withdrawn from the overhead of rectifier 14, either as vapor or liquid. Since the higher $O_2$ content stream from reflux condensor 18 has a higher $O_2$ content than kettle liquid, it is introduced to a warmer (lower) column 1 location than would be used for vapor of kettle liquid composition. This allows the reboil rate through section 1*e* of the $N_2$ removal column to be reduced, and hence argon recovery is increased.

One preferred method of withdrawing argon from rectifier 14 is as a liquid, thus allowing the hydrostatic head of the liquid argon to increase the pressure, and then evaporating it at a lower elevation, e.g., at heat exchanger by heat exchange with supply air. Heat exchanger 21 may be a section of the main exchanger, or a separate exchanger provided only for this duty. Since the overhead of rectifieer 14 is typically over 30 meters above ground level, and liquid argon specific gravity is about 1.4, it is possible to increase the argon pressure about 400 kPa this way without either pump or compressor. Expander 10 effluent can also evaporate the argon. The argon barometric leg compression is useful elsewhere.

Many variations are possible from the illustrated flowsheets without departing from the scope of the disclosed invention. For example other means of evaporating liquid oxygen may be used: exchanger 3, or a partial condensation LOXBOIL exchanger operating at an even higher pressure than 6. Other refrigeration techniques may be used: for example, (a) conventional expansion of HP rectifier $N_2$ to exhaust pressure; (b) partial expansion of HP rectifier $N_2$ as disclosed in copending application Ser. No. 885868 filed July 15, 1986; or (c) partial expansion of part of the supply air with subsequent total condensation of the expanded air in indirect heat exchange with column 1 liquid. The two latter refrigeration techniques are especially valuable when PC LOXBOIL with barometric leg compression of LOX is incorporated. The disclosed sequence of two separate refluxes of argon rectifier overhead by the sequential evaporations of kettle liquid so as to produce two streams of differing $O_2$ content, and then feeding the two streams of different heights, will allow increased argon recovery in any of the above embodiments and others.

In regard to retrofit possibilities, the FIG. 2 flowsheet illustrates that provided an existing argon rectifier can be operated at increased reboil and reflux rates, the major change is to add an additional reflux condenser (13) which can be mounted directly on top of (or beside) the existing condenser (18). Only a minimal number of piping interconnects to the original design are required. In order to take full advantage of the new argon recovery capability some reconfiguration of trays in the $N_2$ removal column 1 is also desirable. Fewer argon stripping section (1*f*) trays are required for a given $O_2$ purity. On the other hand more $N_2$ stripping section (1*e*) trays are needed to keep the $N_2$ content of the crude argon low. Also the reboil duty in section 1*e* is greatly reduced. Higher efficiency, lower pressure drop, and/or lower height contact medium is desirable. The disclosed improvement applies to plants in which the primary products are liquids as well as to gas-producing plants. "Crude argon" refers to those fluids in the argon rectifier which are predominantly argon but which contain some oxygen and/or nitrogen impurity. The argon rectifier is not necessarily at the same pressure as the $N_2$ removal column, and may advantageously be at lower pressure.

I claim:

1. A process for distilling air to produce argon and oxygen of at least 98% purity comprising:

(a) rectifying at least part of the pressurized supply air to kettle liquid and liquid $N_2$;

(b) partially evaporating at least part of the kettle liquid at reduced pressure by exchanging latent heat with crude argon vapor;

(c) separately at least partially evaporating at least part of the liquid remnant from said first partial evaporation step by exchanging latent heat with crude argon vapor;

(d) separately feeding two vapor streams produced from steps (b) and (c) to separate heights of a nitrogen removing distillation column; and (e) rectifying an oxygen-argon mixture from said distillation column to produce quality crude argon by refluxing said rectification step with both of the liquid crude argon streams produced by steps (b) and (c).

2. Process according to claim 1 further comprising feeding part of said kettle liquid directly to said distillation column in liquid phase.

3. Process according to claim 1 further comprising providing at least one and preferably 2 to 6 stages of countercurrent vapor-liquid contact between the feed points of the two vapor streams.

4. Processing according to claim 3 further comprising withdrawing overhead product argon from said oxygen-argon rectification step in liquid phase; increasing the pressure of said liquid argon via the hydrostatic head associated with routing it to a lower elevation; and evaporating said argon at said lower elevation and higher pressure.

5. Process according to claim 3 further comprising obtaining the crude argon vapor for both steps (b) and (c) from the overhead product of said oxygen-argon rectification.

6. Process according to claim 4 further comprising conducting said oxygen-argon rectification in two separate zones of rectification, and supplying the crude argon vapor of step (b) from one zone and that of step (c) from the other.

7. Process according to claim 3 further comprising evaporating product oxygen by exchanging latent heat with a minor fraction of the supply air which essentially totally condenses; splitting the resulting liquid air into at least two streams; and separately providing intermediate reflux to the pressurized air rectification step and the nitrogen-removing distillation step from said respective liquid air streams.

8. Process according to claim 7 further comprising increasing the pressure of said minor fraction of supply air prior to said total condensation.

9. Process according to claim 3 further comprising evaporating product oxygen at a pressure higher than said $N_2$ removing distillation pressure by exchanging latent heat with a major fraction of said supply air.

10. Process according to claim 9 further comprising increasing the liquid oxygen pressure to said evaporating pressure by routing it to a lower elevation thus producing the necessary hydrostatic head.

11. Apparatus for distilling from air oxygen of at least 98% purity and also argon comprising:

(a) a rectification column for at least part of the supply air which produces an oxygen enriched liquid bottom product.

(b) a first reflux condenser in which at least part of said rectifier bottom liquid is partially evaporated;

(c) a second reflux condenser in which at least part of the unevaporated liquid from said first reflux condenser is evaporated;

(d) a nitrogen-removing distillation column including at least two separate vapor feedpoints separated by a zone of countercurrent vapor-liquid contact; and (e) separate conduits for routing vapor from said first reflux condenser to the higher of said feedpoints and vapor from said second reflux condenser to the lower of said feedpoints.

12. Apparatus according to claim 11 further comprising an argon rectifier which supplies vapor to and receives reflux liquid from both of said reflux condensers.

13. Apparatus according to claim 11 further comprising two separate argon rectifiers, each of which supplies overhead vapor to and receives overhead reflux from only one of said two reflux condensers.

14. Apparatus according to claim 11 further comprising means for dividing said kettle liquid into two streams, one for feeding directly to said nitrogen-removing column at a height above both of said vapor feed heights, and the other for supply to said first reflux condenser.

15. Apparatus according to claim 11 further comprised of liquid conduit which conveys overhead liquid argon from at least one argon rectifier which is refluxed by said reflux condensers to a lower elevation where the liquid is at a correspondingly higher pressure due to the hydrostatic head; and means for evaporating said liquid argon at said higher pressure.

16. Apparatus according to claim 11 further comprised of a barometric leg for increasing the pressure of the liquid oxygen bottom product from said nitrogen-removing distillation column to above said column pressure; and a means for evaporating said pressurized liquid oxygen by latent heat exchange with at least part of the supply air.

17. Apparatus according to claim 16 further comprising means for splitting said supply air into a minor fraction which is routed to said oxygen evaporator and a major fraction which is routed to said supply air rectifier.

18. Apparatus according to claim 16 wherein at least a major fraction of said supply air is routed to said oxygen evaporator and subsequently to said supply air rectifier.

19. Process for increasing the argon recovery capability of a dual pressure cryogenic air distillation plant incorporating a supply air rectifier, a nitrogen removal column, and at least one argon rectifier, comprising:

(a) providing two argon rectifier overhead reflux condensers;

(b) routing air rectifier bottom liquid to the first condenser and partially evaporating it;

(c) evaporating at least part of the unevaporated effluent from said first condenser in said second condenser;

(d) routing the vapor from said first condenser to said nitrogen removal column; and (e) separately routing the vapor from said second condenser to a lower height of said nitrogen removal column.

20. Process according to claim 19 further comprised of routing argon rectifier overhead liquid to a lower elevation and evaporating it at an increased pressure.

* * * * *